US009874324B2

(12) United States Patent
Attard et al.

(10) Patent No.: US 9,874,324 B2
(45) Date of Patent: Jan. 23, 2018

(54) SCREENED ENCLOSURE LIGHTING SYSTEM

(71) Applicants: Steven E. Attard, Fort Myers, FL (US); Mark S. Cromika, Fort Myers, FL (US)

(72) Inventors: Steven E. Attard, Fort Myers, FL (US); Mark S. Cromika, Fort Myers, FL (US)

( * ) Notice: Subject to any disclaimer, the term of this patent is extended or adjusted under 35 U.S.C. 154(b) by 0 days.

(21) Appl. No.: 15/693,552

(22) Filed: Sep. 1, 2017

(65) Prior Publication Data

US 2017/0363264 A1 Dec. 21, 2017

Related U.S. Application Data

(63) Continuation-in-part of application No. 14/868,946, filed on Sep. 29, 2015.

(51) Int. Cl.

| | |
|---|---|
| ***E04H 15/10*** | (2006.01) |
| ***F21S 4/20*** | (2016.01) |
| ***F21S 8/04*** | (2006.01) |
| ***F21V 23/00*** | (2015.01) |
| ***F21S 4/28*** | (2016.01) |
| ***F21V 17/16*** | (2006.01) |
| *F21Y 115/10* | (2016.01) |
| *F21Y 103/10* | (2016.01) |

(52) U.S. Cl.

CPC ..... *F21S 8/043* (2013.01); *E04H 15/10* (2013.01); *F21S 4/20* (2016.01); *F21S 4/28* (2016.01); *F21V 17/16* (2013.01); *F21V 17/164* (2013.01); *F21V 23/001* (2013.01); *F21V 23/003* (2013.01); *F21Y 2103/10* (2016.08); *F21Y 2115/10* (2016.08)

(58) Field of Classification Search

CPC .. F21K 9/00; F21K 9/237; F21K 9/238; F21S 2/005; F21S 4/20; F21S 4/22; F21S 4/28; F21S 8/043; F21V 15/00; F21V 15/01; F21V 17/164; F21V 19/004; F21V 21/005; F21V 21/025; F21V 23/003; F21W 2121/004; E04H 15/10

See application file for complete search history.

(56) References Cited

U.S. PATENT DOCUMENTS

| | | | | |
|---|---|---|---|---|
| 4,858,087 A | 8/1989 | Hartshorn | ..... | F21V 15/013 362/125 |
| 4,899,797 A | 2/1990 | Green | | |
| 4,994,944 A | 2/1991 | Vernondier | ..... | E04F 19/061 362/219 |

(Continued)

FOREIGN PATENT DOCUMENTS

WO WO2014/115936 7/2014

OTHER PUBLICATIONS

Nebulalighting.com Printout.
Synergylightingusa.com Printout.
Legrand.us Printout.

*Primary Examiner* — Hargobind S Sawhney
(74) *Attorney, Agent, or Firm* — Edward M. Livingston, Esq.; Bryan L. Loeffler, Esq.; Livingston Loeffler, P.A.

(57) ABSTRACT

A lighting system 1 for screened enclosures (2) wherein side edges (8) of an elongated housing strip (4) mount to a framework (3) of the screened enclosure using screen cable channels (21) located on a frame rail (5) of the framework.

7 Claims, 4 Drawing Sheets

(56) References Cited

U.S. PATENT DOCUMENTS

| | | | | |
|---|---|---|---|---|
| 5,765,939 | A | 6/1998 | Tanner, Jr. | F16L 3/13 362/217.12 |
| 5,813,641 | A | 9/1998 | Baldwin | |
| 6,523,986 | B1 * | 2/2003 | Hoffmann | E04F 19/02 362/153 |
| 6,659,623 | B2 | 12/2003 | Friend | |
| 6,668,495 | B1 | 12/2003 | Prince | |
| 6,796,680 | B1 | 9/2004 | Showers | F21V 15/013 362/240 |
| 7,267,461 | B2 | 9/2007 | Kan | F21V 5/002 362/147 |
| D608,912 | S | 1/2010 | Betty | |
| 7,854,527 | B2 | 12/2010 | Anderson | F21V 3/00 362/133 |
| 8,337,225 | B2 | 12/2012 | Bollmann | H01R 9/2458 439/212 |
| 8,419,209 | B2 | 4/2013 | Mai | F21V 19/009 362/217.14 |
| 8,459,823 | B1 | 6/2013 | Steele et al. | |
| 2007/0294980 | A1 | 12/2007 | Coley | |
| 2008/0298058 | A1 * | 12/2008 | Kan | F21V 15/01 362/240 |
| 2010/0103657 | A1 | 4/2010 | Teng | F21S 2/005 362/223 |
| 2012/0110938 | A1 | 5/2012 | DesJardins, Jr. | |
| 2016/0341377 | A1 * | 11/2016 | Eddins | F21S 10/02 |

* cited by examiner

SCREENED ENCLOSURE LIGHTING SYSTEM

CROSS-REFERENCE TO RELATED APPLICATION

This application is a continuation of application Ser. No. 14/868,946 filed on Sep. 29, 2015, which is currently pending. The patent application identified above is incorporated herein by reference in its entirety to provide continuity of disclosure.

FIELD OF THE INVENTION

This invention relates to outdoor lighting for pools, patios and lanais, and more particularly a low profile lighting system that is installed on a screened enclosure framework.

BACKGROUND OF THE INVENTION

Screened enclosures are commonly installed around patios and/or pools to provide protection from insects, animals and debris, such as leaves. These enclosures are constructed using aluminum frames which are secured to one another to form a framework around the patio and/or pool.

For both safety and aesthetic reasons, there is a desire to provide accent lighting in screened enclosures. However, the height and design of screened enclosures is preventative to installing lighting on screened enclosure frameworks. Past attempts have produced bulky and unsightly lighting systems, which may be pleasant in the dark but are unsightly when the housings, attachment mechanisms and electrical cords of the lights can be seen during the day.

Therefore, a need exists for a lighting system for screened enclosures that is a low profile system, thereby making the components of the lighting system blend into the framework so they are not easily noticeable in the daylight.

SUMMARY OF THE INVENTION

The primary object of the present invention is to provide a lighting system for screened enclosures that is a low profile system, thereby making the components of the lighting system blend into the framework so they are not easily noticeable in the daylight.

An additional object of the present invention is to provide a lighting system for screened enclosures that is easy to install and does not require any alterations to a screened enclosure.

An additional object of the present invention is to provide a lighting system for screened enclosures in which components of the lighting are easily interchangeable.

The present invention fulfills the above and other objects by providing a lighting system wherein side edges of an elongated housing strip mount to a framework of a screened enclosure using U-shaped screen cable channels located on a frame rail of the framework. The side edges of the elongated housing strip are held in place within the screen cable channels by a spring fit wherein tension created by squeezing the edges of the elongated housing strip together when inserting the edges into the screen cable channels pushes the edges of the elongated housing strip outward against an inner surface of the U-shaped screen cable channels, thereby reducing and/or eliminating the need for mechanical fasteners during installation.

The elongated housing strip preferably has a flat panel with angled sides but may have any profile that provides a distance between the edges that is approximate to the distance between the screen cable channels on which the elongated housing strip is being installed.

In addition, the edges of the elongated housing strip may have rounded profiles similar to screen cable to allow the edges to be secured within screen cable channels on a frame rail. For example, the edges may be rounded and malleable with a smooth or ridged surface. The rounded edges may be used in addition to or in instead of a spring fit to attach the elongated housing strip to a frame rail.

The elongated housing strip has an inner surface on which lights, which are preferably LED lights are mounted thereto. Apertures in the elongated housing strip allow the lights to extend and/or shine through the elongated housing strip. Alternatively, the lights may be mounted to an outer surface of the elongated housing strip. Wiring and electrical connections are also housed within the elongated housing strip, thereby being shielded from view when the elongated housing strip is installed. Each elongated housing strip preferably has an electrical connection to attach the multiple elongated housing strips together and/or to wiring that connects to an electrical source and/or controller used for operating the lighting system. Caps may be used to conceal ends of elongated housing strips that terminate without connecting to another component.

External wires are preferably inserted into the screen cable channels in the enclosure frame, thereby hiding the external wires from view. The eternal wires are preferably colored to match the color of the screened enclosure framework. The external wires may be conventional wires or may have shapes and structure similar to a conventional screen cable. For example, the external wires may be rounded and malleable with a smooth or ridged surface.

In addition, the lighting system of the present invention may include additional components, such as spotlights and so forth, that are wired through the elongated housing strips.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
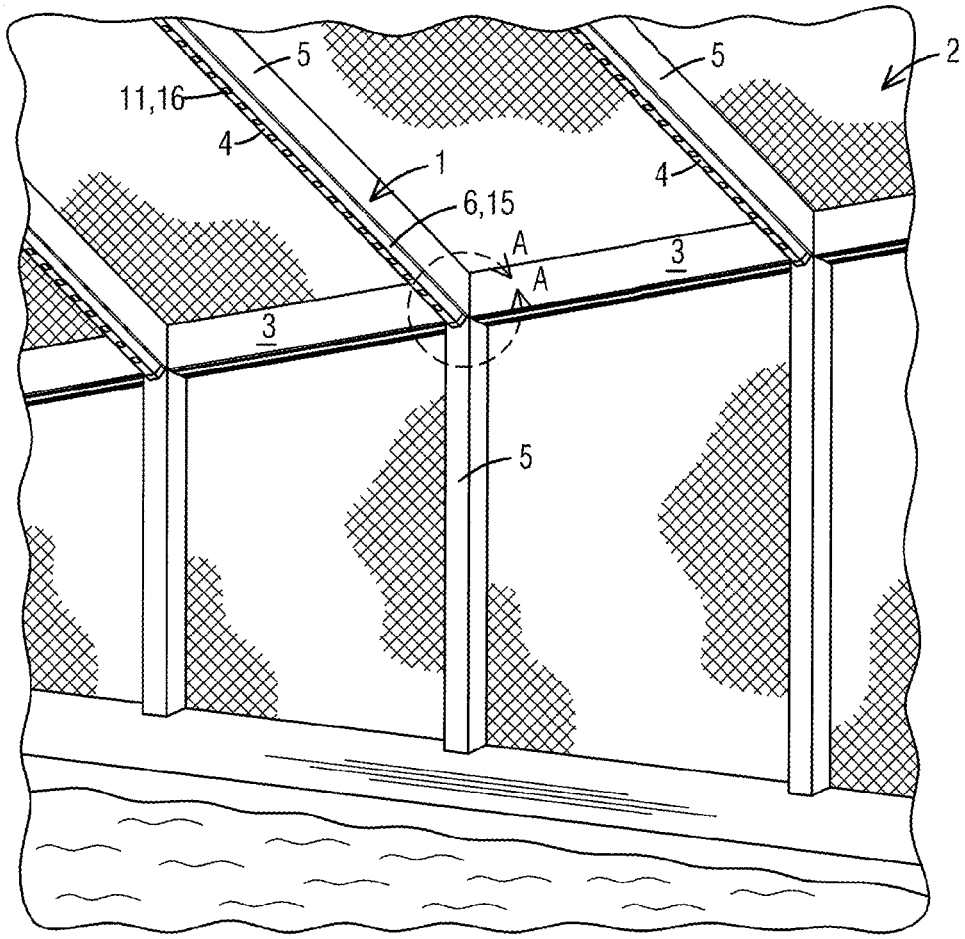
FIG. 1 is an interior view of a screened enclosure wherein the lighting system of the present invention is installed on the framework.

For purposes of describing the preferred embodiment, the terminology used in reference to the numbered components in the drawings is as follows:

1. lighting system, generally
2. screened enclosure
3. framework
4. elongated housing strip
5. frame rail
6. outer surface of elongated housing strip
7. inner surface of elongated housing strip
8. side edge of elongated housing strip
9. end edge of elongated housing strip
10. hollow portion of elongated housing strip
11. light
12. electrical wiring
13. electrical connector
14. raised center panel
15. angled side panel
16. LED light
17. aperture
18. electrical source
19. controller
20. cap
21. screen cable channel
22. inner surface of a screen cable channel
23. rounded profile
24. remote control
25. component With reference to FIG. 1, an interior view of a screened enclosure 2 wherein the lighting system 1 of the present invention is installed on a framework 3 of the screened enclosure 2 is illustrated. The lighting system 1 of the present invention comprises low profile elongated housing strip 4 that attaches to a frame rail 5, as further illustrated in FIG. 5, in a manner that makes it blend in with the frame rail 5 when visible in daylight. As illustrated here, a plurality of elongated housing strips 4 may be mounted on the frame rails 5 that form a roof 6 of the screened enclosure 2 so that the light emitted by the lighting system 1 shines downward on a patio surface and/or a pool or spa.

Figure 2:
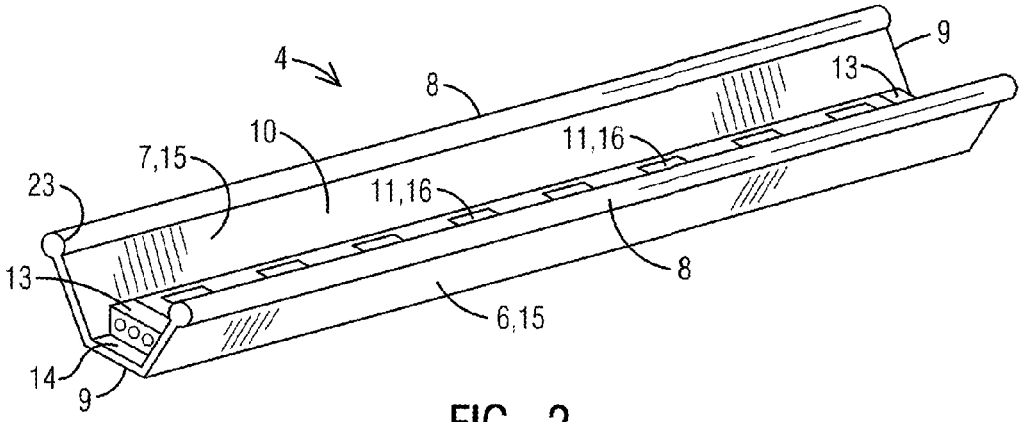
FIG. 2 is a side perspective view of an elongated housing strip of the present invention.
Figure 3:
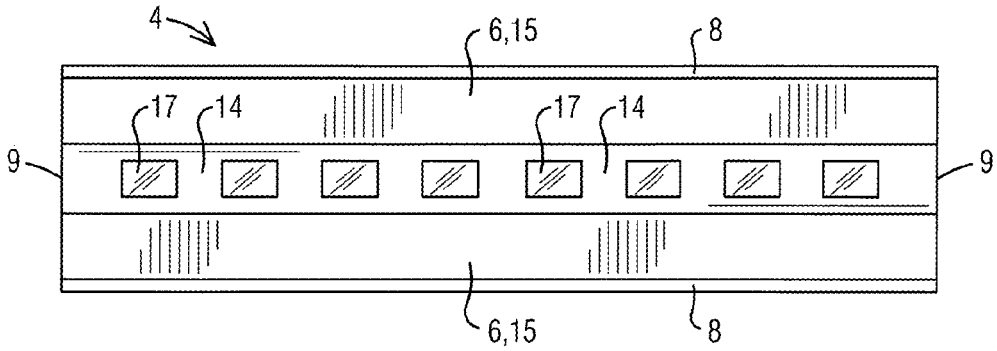
FIG. 3 is a rear view of an elongated housing strip of the present invention.
Figure 4:
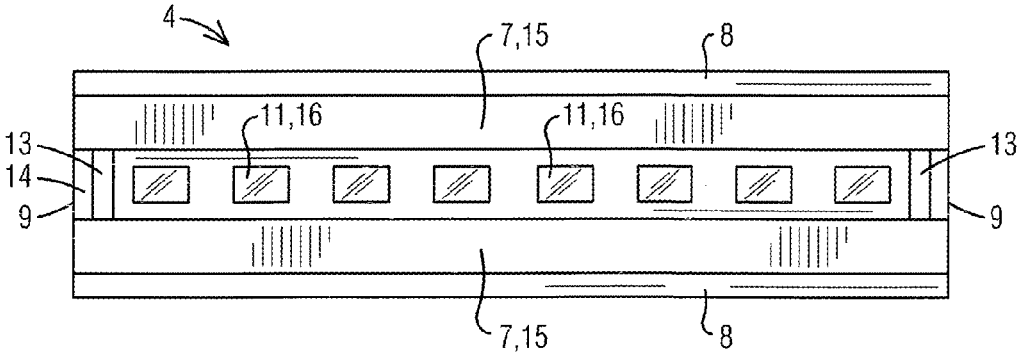
FIG. 4 is a front view of an elongated housing strip of the present invention.

With reference to FIGS. 2-4, a side perspective view, a rear view and a front view, respectively, of an elongated housing strip 4 of the present invention are illustrated. The elongated housing strip 4 comprises an outer surface 6, an inner surface 7, side edges 8 and end edges 9. The elongated housing strip 4 may be a curved panel or have a raised profile of a predetermined shape that creates a hollow portion 10 within the inner surface 7 in which one or more lights 11, electrical wiring 12, electrical connectors 13 and so forth may be located and hidden from view. As illustrated here, the elongated housing strip 4 comprises a raised center panel 14 with angled side panels 15 creating a trapezoidal shape when attached to a frame rail 5. Said end edges 9 may further comprise attachment means, such as male/female connectors, snap connectors and so forth, located thereon to attach each elongated strip 4 together.

Figure 6:
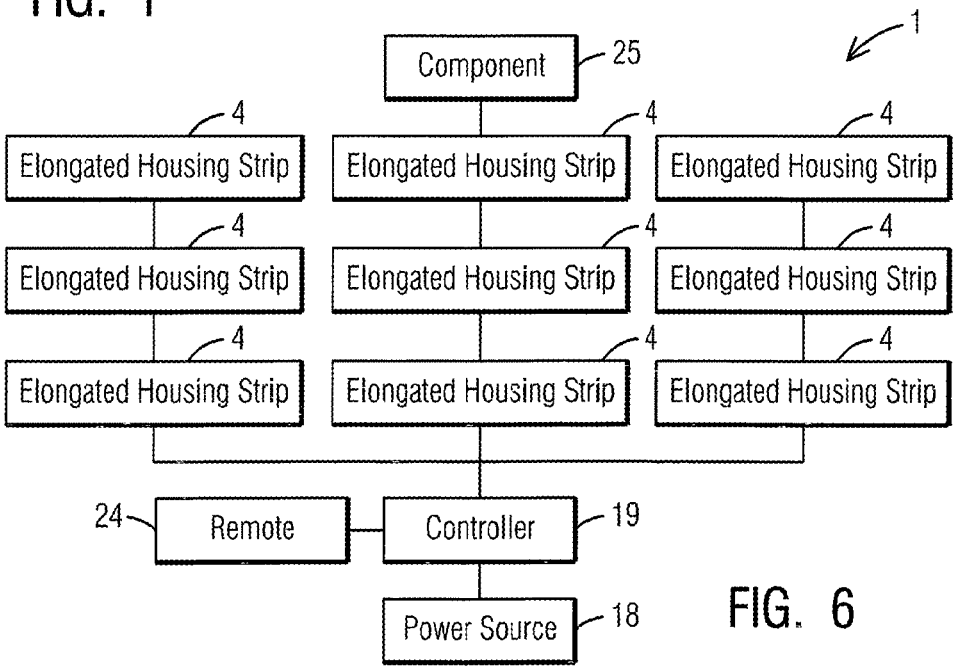
FIG. 6 is a block diagram of a lighting system of the present invention.

A plurality of lights 11, which are preferably LED lights 16, are located on the inner surface 7 of the elongated housing strip 4. Apertures 17 located on the elongated housing strip 4 allow the lights 11 to extend and/or shine through the elongated housing strip 4. Each elongated housing strip 4 preferably has one or more electrical connectors 13 to attach a plurality of elongated housing strips 4 together and/or to an electrical source 18 and/or controller 19 used for operating the lighting system 1, as illustrated in FIG. 6. The controller 19 may be a stationary hard wired control and/or remote control used for activating and deactivating the lights 11 and controlling a plurality of other functions in the lighting system 1.

Figure 5:
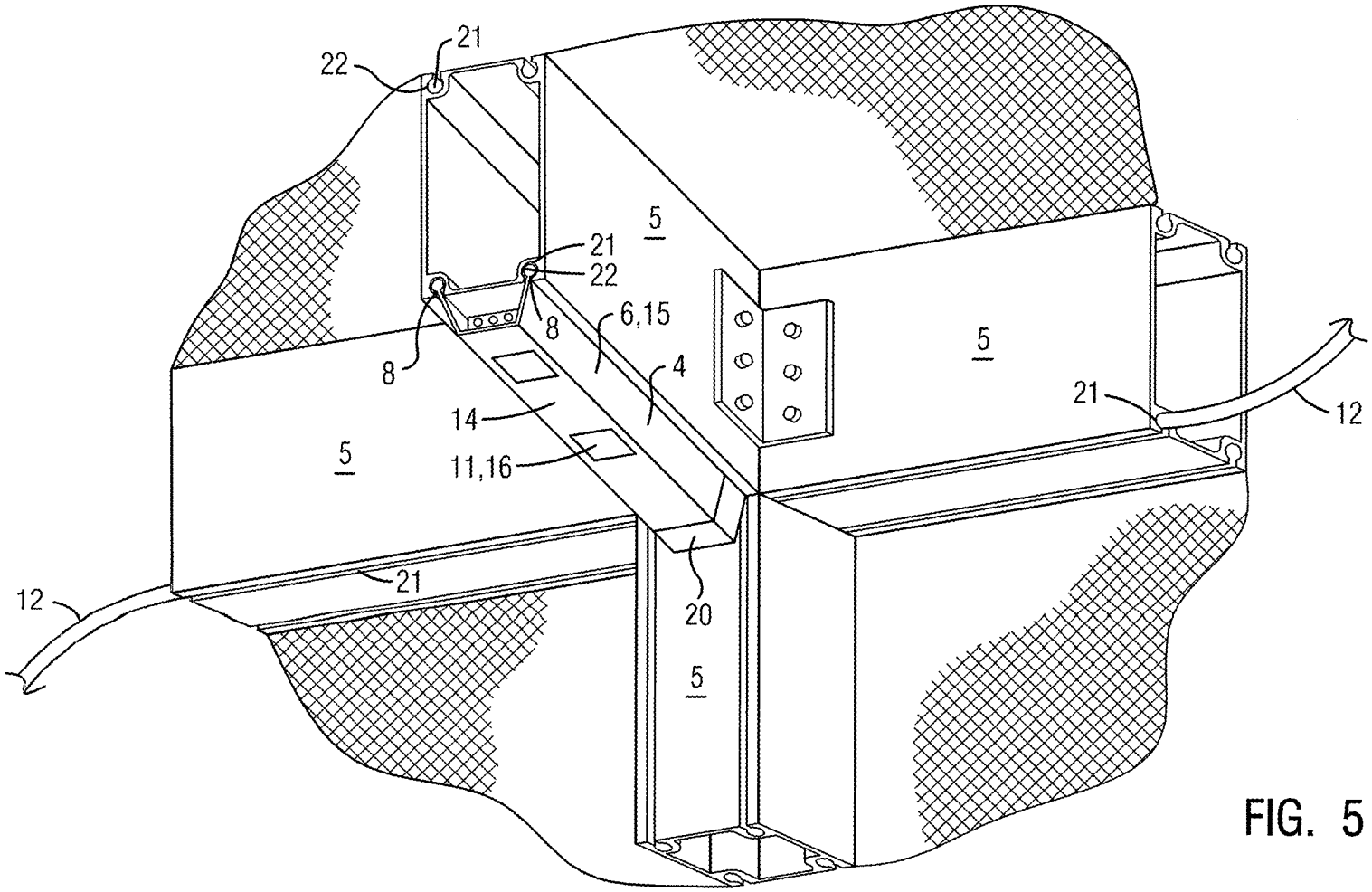
FIG. 5 is a side perspective cutaway view along line A-A of FIG. 1 of an elongated housing strip of the present invention attached to a frame rail of a screened enclosure.

With reference to FIG. 5, a side perspective cutaway view along line A-A of FIG. 1 of an elongated housing strip 4 of the present invention attached to a frame rail 5 of a screened enclosure 2 is illustrated. The elongated housing strip 4 connects to U-shaped screen cable channels 21 located on a frame rail 5 of a screened enclosure 2. The side edges 8 of the elongated housing strip 4 are held in place within the screen cable channels 21 by a spring fit wherein tension created by squeezing the side edges 8 of the elongated housing strip 4 together prior to inserting the side edges 8 into the screen cable channels 21 pushes the side edges 8 of the elongated housing strip 4 outward against an inner surface 22 of the U-shaped screen cable channels 21, thereby reducing and/or eliminating the need for mechanical fasteners during installation of the lighting system 1 of the present invention.

In addition, the side edges 8 of the elongated housing strip 4 may have rounded profiles 23 similar in shape to conventional screen cable to allow the edges 8 of the elongated housing strip 4 to be secured within the screen cable channels 21 on a frame rail 5. For example, the edges 8 of the elongated housing strip 4 may be rounded and malleable with a smooth or ridged surface that locks the edges 8 within the screen cable channels 21 by a friction fit. The rounded profiles 23 may be used in addition to or in instead of a spring fit to attach the elongated housing strip 4 to a frame rail 5.

External electrical wiring 12 not enclosed in the elongated housing strips 4 are preferably inserted into the screen cable channels 21 in the frame rails 5, thereby hiding the external electrical wiring 12 from view. The external electrical wiring 12 are preferably colored to match the color of the screened enclosure framework 2. The external electrical wiring 12 may be conventional electrical wires or may have shapes and structure similar to a conventional screen cable. For example, the external electrical wiring 12 may be rounded and malleable with a smooth or ridged surface.

Caps 20 may be used to conceal open ends of elongated housing strips 4 that terminate without connecting to another component to provide a finished look and to protect the contents of the elongated housing strips 4.

With reference to FIG. 6, a block diagram of a lighting system 1 of the present invention is illustrated. Each elongated housing strip 4 preferably has one or more electrical connectors or conventional manual electrical connections to attach a plurality of elongated housing strips 4 together. The elongated housing strips 4 are then connected to an electrical power source 18 and controller 19 used for operating the lighting system 1. The controller 19 may be a stationary hard wired control that can be operated manually or by a remote control 24 used for activating and deactivating the lights 11 and controlling a plurality of other functions in the lighting system 1. In addition, the lighting system 1 of the present invention may include additional components 25, such as spotlights and so forth, which are wired through the elongated housing strips 4.

Figure 7:
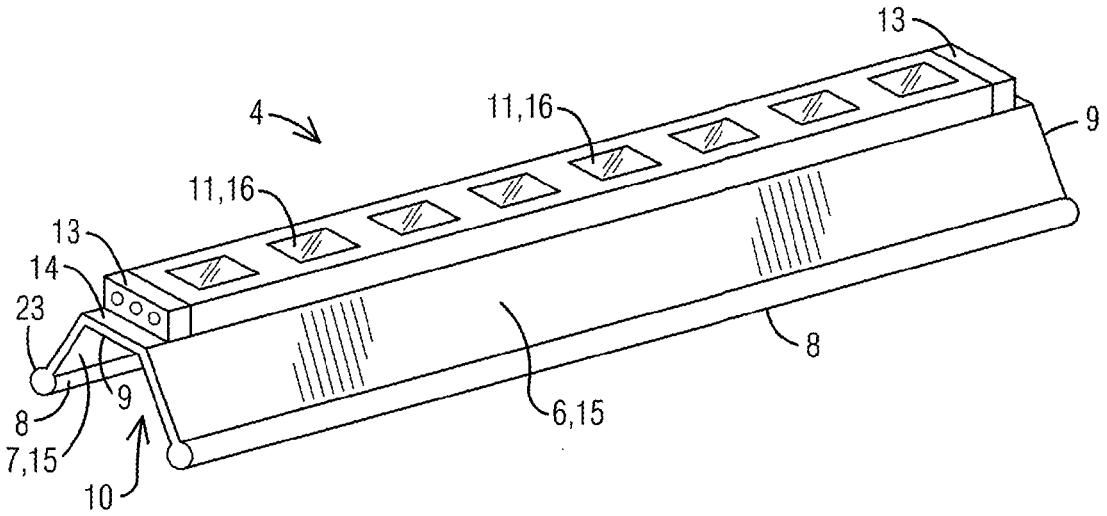
FIG. 7 is a side perspective view of an elongated housing strip of the present invention wherein lights are located on the outer surface of elongated housing strip.
Figure 8:
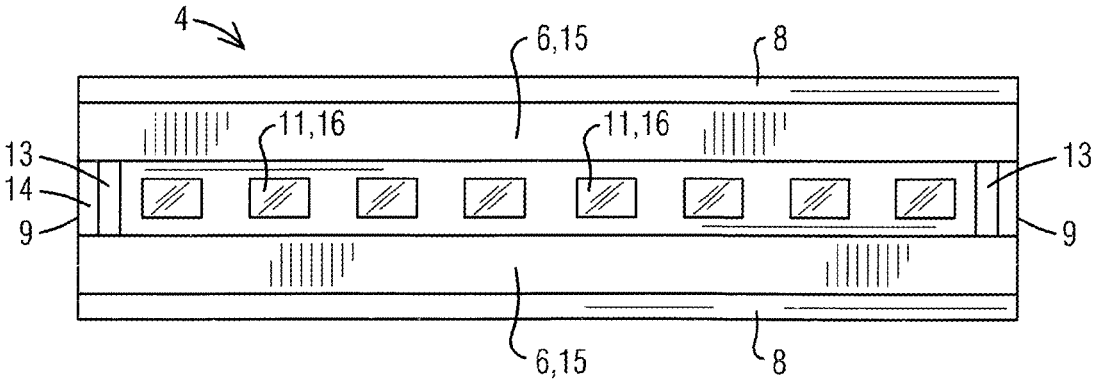
FIG. 8 is a front view of an elongated housing strip of the present invention wherein lights are located on the outer surface of elongated housing strip.

With reference to FIGS. 7 and 8, a side perspective view and a front view, respectively, of an elongated housing strip 4 of the present invention are illustrated wherein lights 11 are located on the outer surface 6 of elongated housing strip 4. The elongated housing strip 4 comprises an outer surface 6, an inner surface 7, side edges 8 and end edges 9. The elongated housing strip 4 may be a curved panel or have a raised profile of a predetermined shape that creates a hollow portion 10 within the inner surface 7 in which one or more lights 11, electrical wiring 12, electrical connectors 13 and so forth may be located and hidden from view. As illustrated here, the elongated housing strip 4 comprises a raised center panel 14 with angled side panels 15 creating a trapezoidal shape when attached to a frame rail 5. Said end edges 9 may further comprise attachment means, such as male/female connectors, snap connectors and so forth, located thereon to attach each elongated strip 4 together.

A plurality of lights 11, which are preferably LED lights 16, are located on the outer surface 6 of the elongated housing strip 4. Each elongated housing strip 4 preferably has one or more electrical connectors 13 to attach a plurality of elongated housing strips 4 together and/or to an electrical source 18 and/or controller 19 used for operating the lighting system 1, as illustrated in FIG. 6. The controller 19 may be a stationary hard wired control and/or remote control used for activating and deactivating the lights 11 and controlling a plurality of other functions in the lighting system 1.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, we claim:

1. A lighting system for screened enclosures comprising:

an elongated housing strip having an outer surface, an inner surface, side edges and end edges;

said elongated housing strip having a raised profile with a plurality of lights located on the outer surface of the elongated housing strip;

said side edges being flexible enough to be squeezed inward to create an outward tension on the side edges when said side edges are placed within screen cable channels of a frame rail of a screened enclosure; and said elongated housing strip comprises a raised center panel with angled side panels that creates a trapezoidal shape when attached to a frame rail of a screened enclosure.

2. The lighting system for screened enclosures of claim 1 wherein:

said plurality of lights are LED lights.

3. The lighting system for screened enclosures of claim 1 wherein:

the side edges of the elongated housing strip have rounded profiles.

4. A method for installing a lighting system for screened enclosures wherein said lighting system comprises an elongated housing strip having an outer surface, an inner surface, side edges and end edges, said elongated housing strip having a raised profile with a plurality of lights located on the outer surface of the elongated housing strip, and said side edges being flexible enough to be squeezed being squeezed inward; said method comprising the steps of:

a. attaching at least one elongated housing strip to a frame rail of a screened enclosure by inserting side edges of the at least one elongated housing strip into screen cable channels of the frame rail;

b. connecting the at least one elongated housing strip to a controller using an electrical wire; and c. connecting the controller to a power source using an electrical wire.

5. The method of claim 4 further comprising the step of:

inserting an electrical wire into screen cable channel of a frame rail of the screened enclosure.

6. A lighting system for screened enclosures wherein said lighting system comprises an elongated housing strip having an outer surface, an inner surface, side edges and end edges, said elongated housing strip having a raised profile with a plurality of lights located on the outer surface of the elongated housing strip, and said side edges being flexible enough to be squeezed being squeezed inward; said lighting system comprising:

at least one elongated housing strip attached to a frame rail of a screened enclosure by inserting side edges of the at least one elongated housing strip into screen cable channels of the frame rail;

the at least one elongated housing strip connected to a controller using an electrical wire; and the controller connected to a power source using an electrical wire.

7. The lighting system of claim 6 further comprising:

an electrical wire inserted into screen cable channel of a frame rail of the screened enclosure.

* * * * *